US005327826A

United States Patent [19]

Rodi

[11] Patent Number: 5,327,826

[45] Date of Patent: Jul. 12, 1994

[54] REGISTER ADJUSTMENT DEVICE ON A PRINTING MACHINE WITH A PLURALITY OF PRINTING UNITS AND METHOD OF OPERATING THE DEVICE

[75] Inventor: Anton Rodi, Leimen, Fed. Rep. of Germany

[73] Assignee: Heidelberger Druckmaschinen AG, Heidelberg, Fed. Rep. of Germany

[21] Appl. No.: 594,730

[22] Filed: Oct. 9, 1990

[30] Foreign Application Priority Data

Oct. 9, 1989 [DE] Fed. Rep. of Germany ..... 3933666

[51] Int. Cl.[5] ..... B41F 5/06; B41F 33/16

[52] U.S. Cl. ..... 101/181; 101/486

[58] Field of Search ..... 101/181, 183, 184, 185, 101/248, 485, 486; 226/2, 3, 15, 16, 20, 28, 42

[56] References Cited

U.S. PATENT DOCUMENTS

| | | | |
|---|---|---|---|
| 3,165,056 | 1/1965 | Heatley, Jr. et al. | 101/181 |
| 3,963,902 | 6/1976 | Dowd | 235/103.5 R X |
| 4,484,522 | 11/1984 | Simeth | 101/181 X |
| 4,572,074 | 2/1986 | Guaraldi | 101/181 |
| 4,665,824 | 5/1987 | Greiner et al. | 101/DIG. 46 |
| 4,821,640 | 4/1989 | Hajek et al. | 101/248 X |
| 4,856,903 | 8/1989 | Kipphan et al. | 356/400 |
| 4,932,320 | 6/1990 | Brunetti et al. | 101/181 |

FOREIGN PATENT DOCUMENTS

| | | |
|---|---|---|
| 0187192 | 7/1986 | European Pat. Off. . |
| 0241773 | 10/1987 | European Pat. Off. . |
| 0286982 | 10/1988 | European Pat. Off. . |
| 8214995 | 3/1983 | France . |
| 86/05141 | 9/1986 | France . |
| 2109586 | 6/1983 | United Kingdom . |

OTHER PUBLICATIONS

Publication "Der Moderne Druck", Kollecker/-Matuschke, 1956, pp. 430–445; Translation of 431 & 432.

*Primary Examiner*—J. Reed Fisher

*Attorney, Agent, or Firm*—Herbert L. Lerner; Laurence A. Greenberg

[57] ABSTRACT

A printing machine having a plurality of printing units, and circumferential and side register adjusting devices for adjusting the register in all but one of the printing units, the one printing unit being non-adjustable, includes a control-command input device operatively associated with the non-adjustable one printing unit for producing a relative change in position of a subject in the non-adjustable one printing of a register adjustment of the one printing unit as a result of logically consistent register adjustments of the printing units having the circumferential and side register adjusting devices, and method of operation.

11 Claims, 6 Drawing Sheets

Figure 1:
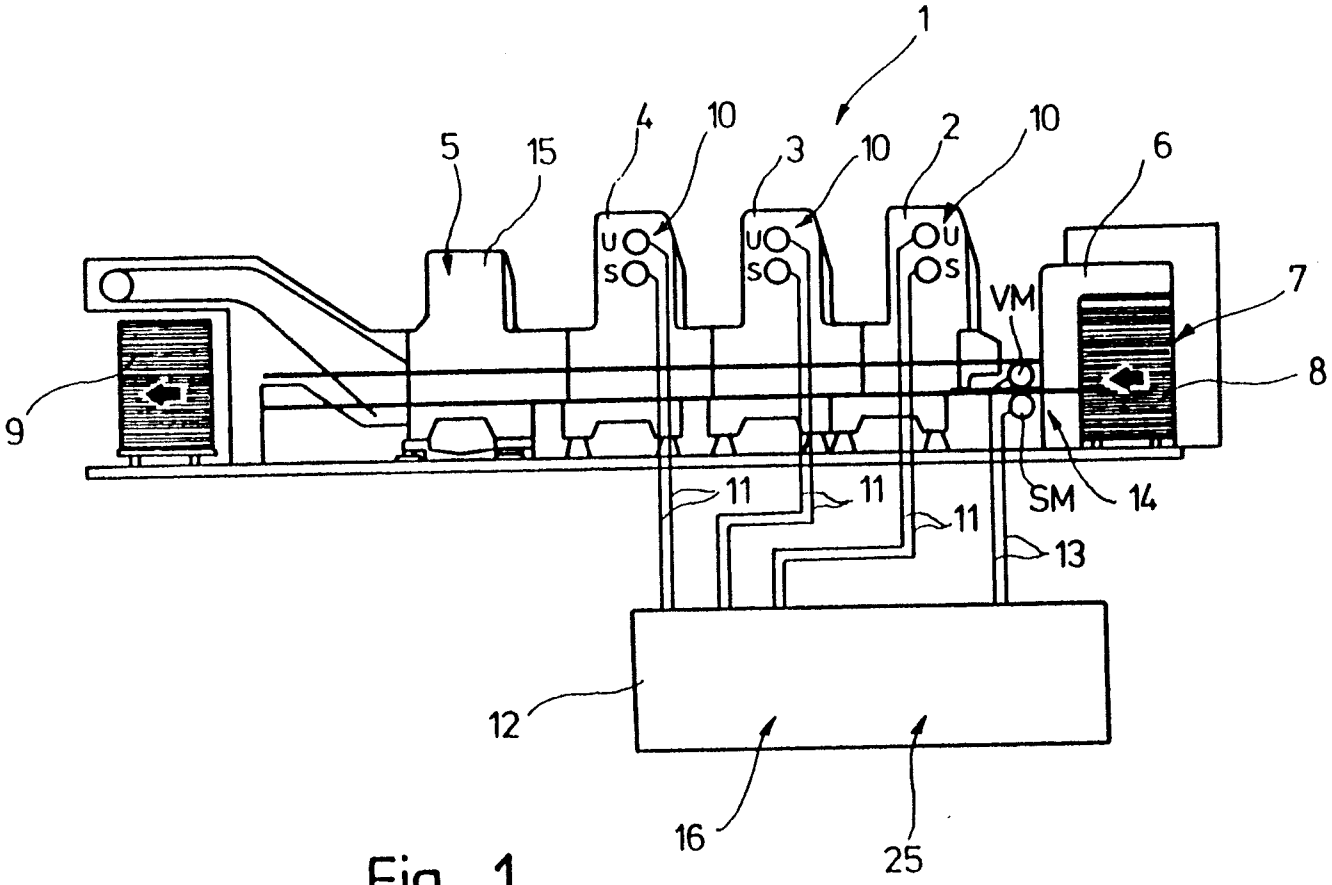

REGISTER ADJUSTMENT DEVICE ON A PRINTING MACHINE WITH A PLURALITY OF PRINTING UNITS AND METHOD OF OPERATING THE DEVICE

The invention relates to a register adjustment device on a printing machine with a plurality of printing units and method of operating the device. Except for one of the printing units, they are each provided with circumferential and side register adjustment devices.

Offset printing machines with a plurality of printing units have become known heretofore for multicolor printing, the printing units being provided with circumferential and side register adjusting devices for register adjustment. It is possible thereby to correct respective positions of individual printing plates for different color separations, which is of great importance with respect to the quality of the printed product. The circumferential and side register adjusting devices require elaborate and, therefore, cost-intensive construction measures. It is a usual practice, therefore, to forego register-correction means in the printing unit of an offset printing machine located at the delivery end if that printing unit is in the form of a varnishing unit. A correction of the varnishing-unit register is, therefore, possible only by the use of elaborate measures, such as changing the position of the rubber blanket on the rubber-blanket cylinder. This requires extensive operations (in particular: releasing or loosening, aligning, clamping, and so forth). Moreover, adjustment is difficult and success is also considerably dependent upon the skill and experience of the printer.

It is an object of the invention, therefore, to provide a printing machine of the aforementioned general type in which it is possible, in a simple and economical manner, to attain correct positions of the subjects of the printing units.

With the foregoing and other objects in view, there is provided, in accordance with the invention, a printing machine having a plurality of printing units, and circumferential and side register adjusting devices for adjusting the register in all but one of the printing units, the one printing unit being non-adjustable, comprising a control-command input device operatively associated with the non-adjustable one printing unit for producing a relative change in position of a subject in the non-adjustable one printing unit and nearby producing and effect of a register adjustment of the one printing unit as a result of logically consistent register adjustments of the printing units having the circumferential and side register adjusting devices.

In accordance with another feature of the invention, the non-adjustable printing unit is a varnishing unit.

Thus, there is, as it were, a fictitious "setting" of the one non-adjustable printing unit in that the position of its subject is changed in relation to the positions of the subjects of the other printing units, this being accomplished by no change in position of the subject of the non-adjustable printing unit (which, due to its lack of adjustability, would not be possible in the first place), but by logically consistent, relative register adjustments of the adjustable printing units having circumferential and side register adjusting devices. For effecting a correct alignment of the individual printing plates, the adjustable printing units are adjusted or set to align precisely without overlap with the position of the subject of the one non-adjustable printing unit. This is made possible, for example, in a relatively simple manner from the control console of the printing machine due to the control-command input device according to the invention. The control commands can be inputted manually or even automatically. It is possible to dispense with the aforedescribed elaborate, heretoforeknown measures, such as the positional correction of the rubber blanket, for example. The invention is not restricted to constructing the non-adjustable printing unit as a varnishing unit, but can be employed, for example in multicolor printing, also in the printing unit of a specific color separation. Because, it is possible, in accordance with the invention, to forego register adjustment in this printing unit, the construction thereof is simplified. A corresponding saving in costs is the result.

In accordance with another feature of the invention, a printing form in the printing units having the circumferential and side register adjusting devices has a register mark thereon for detection of positions of respective subjects being processed in the last-mentioned printing units.

Such register marks are provided on the printing form, particularly the printing plate, and are visible in the form of a corresponding impression on the printed product. The register marks are preferably in the form of register crosses. These register crosses are usually in the non-image area of the stock material, for example in the region of the corners of a printed sheet. These register crosses permit simple and accurate positional regulation of the subjects or printing plates of the individual printing units in that the relative positions of the individual register crosses are detected and are brought into precise alignment with one another by means of register adjustment. A result thereof is that, also, the subjects of the printing plates associated with the printing units are in precise alignment without overlap with respect to one another. Such register marks are provided, however, only on the adjustable printing units, i.e. those provided with circumferential and side register adjusting devices. If, as in the case of a varnishing unit, there is a non-adjustable printing unit, it is not possible to employ positional detection by means of register marks. In order to assess the position of the subject, it is necessary to have recourse, for example, to the determination of the position of the margin or edge of the subject.

In accordance with an additional feature of the invention, there is provided a control unit for initiating an adjustment of register, the control unit being connected to the control command input device.

The inputting of a desired positional correction causes the control unit to initiate the required register adjustment. In this connection, the control unit may execute the setting or adjustment of the registers consecutively or simultaneously. Simultaneous settings ensure the realization of very brief set-up times.

In all cases, the register adjustment according to the invention is executed with logical consistency both in terms of magnitude and in terms of direction. Because this is possible in both the circumferential and side directions, a comprehensive possibility for correction is provided.

In accordance with an added feature of the invention, the control unit has means for automatically applying adjustment data derived from an adjustment of the register of one of the adjustable printing units, which has been selected as a lead printing unit, to adjust the others of the adjustable printing units, taking into account position-deviation data with respect to the lead printing unit existing before the adjustment. The lead printing unit prints the so-called base color, it being possible in multicolor printing to nominate as the base color one of the colors C, M, Y (C=Cyan, M=Magenta, Y=Yellow) or B (B=Black), for example. Once the relative positions of the subjects of the adjustable printing units other than the lead printing unit with respect to the base color printing, adjustable printing unit are known, then, to attain a precise alignment of the individual adjustable printing units with respect to one another, it is merely necessary to determine the adjustment data with regard to the lead printing unit in relation to the position of the subject of the non-adjustable printing unit. If these adjustment data are inputted into the control-command input device, there occurs not only a register adjustment of the base color printing unit, but also, simultaneously, a register setting or adjustment of all of the other adjustable printing units, because the register positions to be assumed by the adjustable printing units can be determined automatically based upon the existing data. This results in a considerable simplification of the work required and also in a very high setting or adjustment accuracy. The high setting accuracy results from the fact that the positions of the subjects of the individual adjustable printing units can be determined with great accuracy based upon the aforedescribed register crosses. Overall, therefore, it is possible to perform a precise register setting or adjustment of all of the printing units, with the result that substantially waste-free printing is possible.

Because the position-deviation data are established by determination of the positions of the machine-readable register marks, automatic measuring by means of a register mark reader, in particular a register cross reader, is possible. The register cross reader is an optical instrument which detects the register crosses with a lens arrangement and evaluates them with respect to their positions. The necessary corrections of the register settings on the printing units are computed by the instrument and/or by the control input and are, if required, indicated directly on a display. According to a feature of the invention, however, the computing data can also be supplied directly to the control desk of the printing machine and can be used to control the actuators for the circumferential and side registers. Such a register-cross reader has become known heretofore from German Published, Non-Prosecuted Application (DE-OS) 37 19 766, to the contents of which reference is hereby made.

Because the measures indicated may result in deviations between the position of the subject of the printed product and the edge of the stock material, in accordance with a further feature of the invention, there is provided a side and first lays for aligning stock material fed to the machine, the side and front lays being adjustable by the control unit so that a subject of a printed product is at a desired spacing from edges of the stock material.

If the printing medium is in the form of a sheet-fed printing machine, the individual sheets fed, for example, from a suction-head device, are positioned in accordance with the positioning of the side and front lays. This compensates again for the displacement of the subject with respect to the edge of the stock, such displacement resulting from the circumferential and side register adjustments. If the register adjustments lead to a displacement (magnitude and direction) of the printed image, the side and front lays are adjusted by the same magnitude and in the same direction, so that, overall, the deviations are again compensated for. Such compensatory adjustment may, of course, also be performed automatically by the control system of the printing machine.

Preferably, the setting of the registers and the adjusting of the side and front lays, respectively, are performed uniformly at low speed. This measure prevents the production of waste when adjustment is performed while the printing machine is in operation, because, when a uniform speed of setting and adjusting exists, the individual color separations remain in alignment with one another without any overlays, even during the adjusting process. The low speed ensures that, during setting and adjusting, no marked increase in size of the halftone dots of the printed images occurs, because the ink dots which form and fade away on the respective rubber blankets of the printing machine due to the displacement deviate only to an insignificant extent in form, i.e., the deviation is not visible under normal viewing. In particular, provision is made for the speed of setting and adjusting to be dependent upon the positioning travel and/or the speed of the printing machine. In the case of a small deviation, i.e., in the case of only a short positioning travel, it is possible, without considerably deteriorating the print quality, to operate at a relatively high speed of setting and adjusting. This applies also to high printing-machine speeds.

In accordance with another aspect of the invention, there is provided a method of correcting a register setting in printing units of a printing machine, all but one of the printing units having circumferential and side register adjusting devices for adjusting the register, the one printing unit being non-adjustable, which comprises performing logically consistent register adjustments of the adjustable printing units so as to change the relative position of a subject of the one non-adjustable printing units and thereby producing an effect of a register adjustment of the one non-adjustable printing unit.

In accordance with a further mode of the invention, the method comprises selecting as a lead printing unit one of the adjustable printing units having a subject or color separation in as close to a desired position as possible with respect to edges of the stock material. The lead printing unit prints the so-called base color. Furthermore, the relative position deviations of the subjects of the adjustable printing units with respect to the position of the subject of the lead printing unit are determined and stored in a storage device provided for this purpose. Such determination can be performed in particularly simple manner with a register-mark reader, in particular a register-cross reader. The optical device of the register-cross reader is directed at the register crosses of a proof/specimen print or similar, so that the instrument is able to determine the existing deviation data and to feed them to the storage device. Determination and evaluation are preferably automatic. Because the printed image of the non-adjustable printing unit, which is, in particular, in the form of a varnishing unit, has no register crosses or the like, the positional deviation of the subject of the lead printing unit with respect to the position of the subject of the non-adjustable printing unit must be determined by the printer and be inputted at the control console of the printing machine.

Preferably, the printer uses the margins or edges of the subject to determine the positional deviation. Based upon the stored position-deviation data between the position of the subject of the lead printing unit and the positions of the subjects of the other adjustable printing units, a register adjustment of the lead printing unit causes an automatic, logically consistent correction of the register settings of the other adjustable printing units. This ensures, with great accuracy and relatively little effort, the correction of the register settings at the printing units of the printing machine. In particular, the printer need merely determine "manually" the positional deviation between the subject of the lead printing unit and the position of the subject of the non-adjustable printing unit; the other positions or positional deviations are automatically detected by the register-cross reader and are relayed to the control unit of the printing machine.

Other features which are considered as characteristic for the invention are set·forth in the appended claims.

Although the invention is illustrated and described herein as embodied in a register adjustment device on a printing machine having a plurality of printing units, and method of operating the device, it is nevertheless not intended to be limited to the details shown, since various modifications and structural changes may be made therein without departing from the spirit of the invention and within the scope and range of equivalents of the claims.

Figure 2:
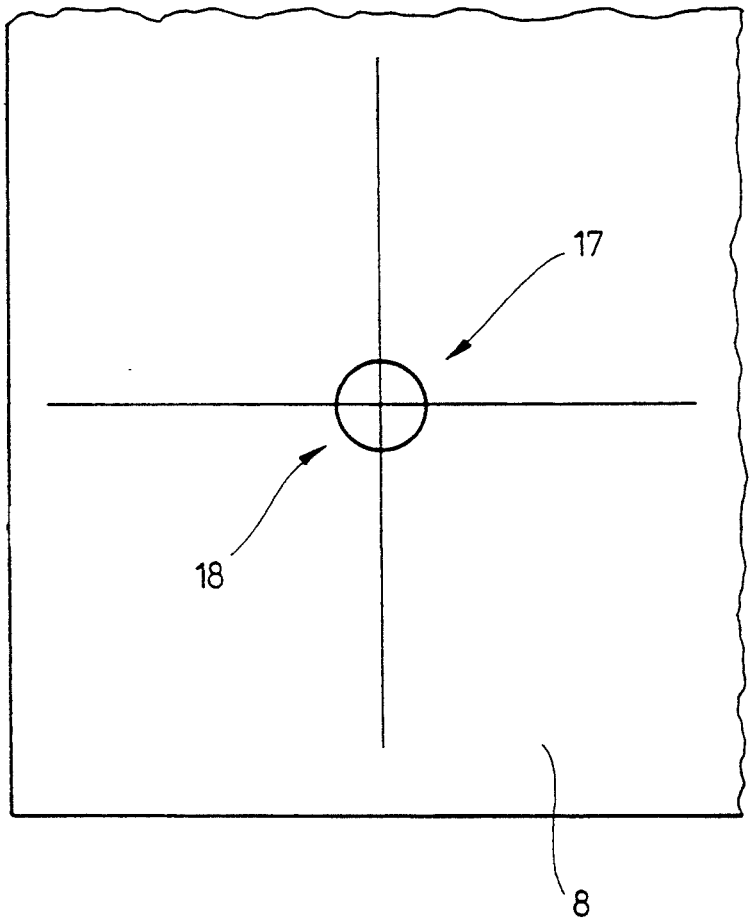
Figure 3:
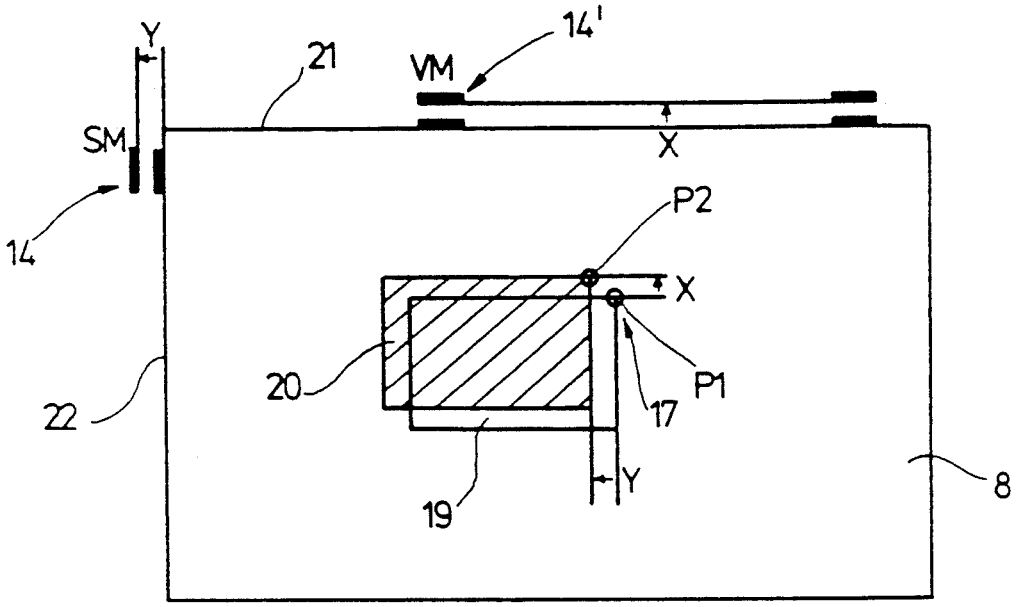
Figure 4A:
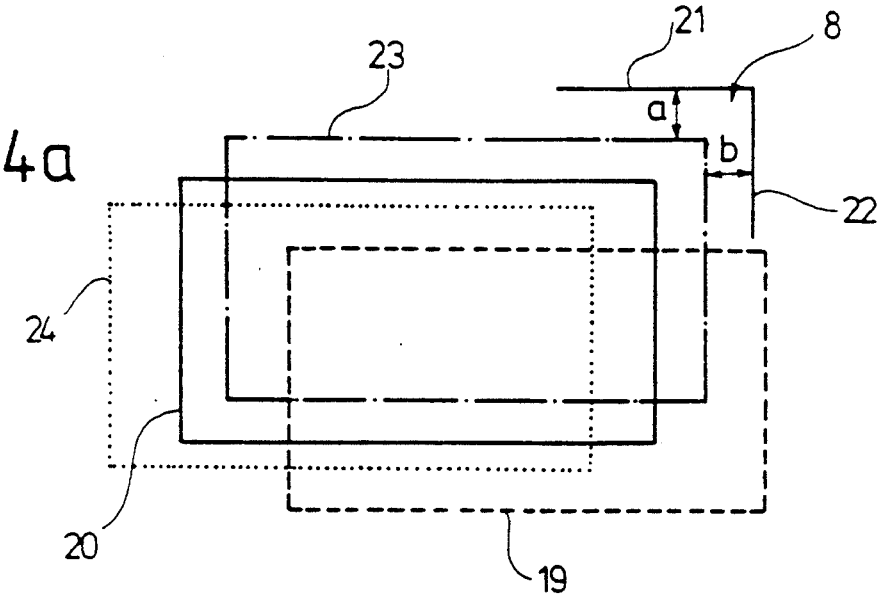
Figure 4B:
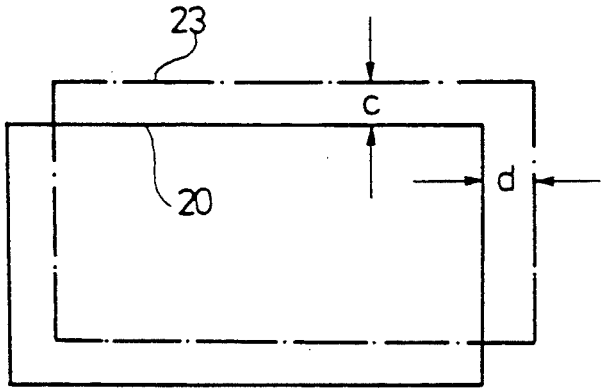
Figure 4C:
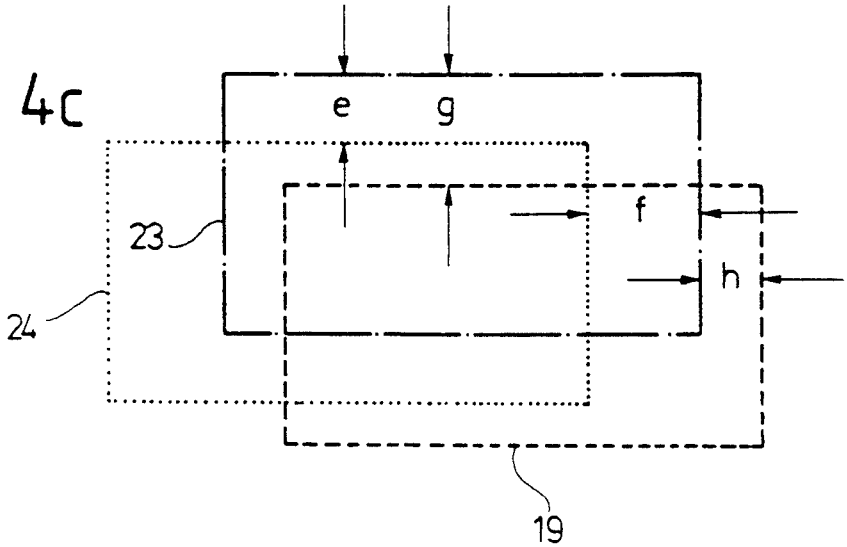
Figure 5:
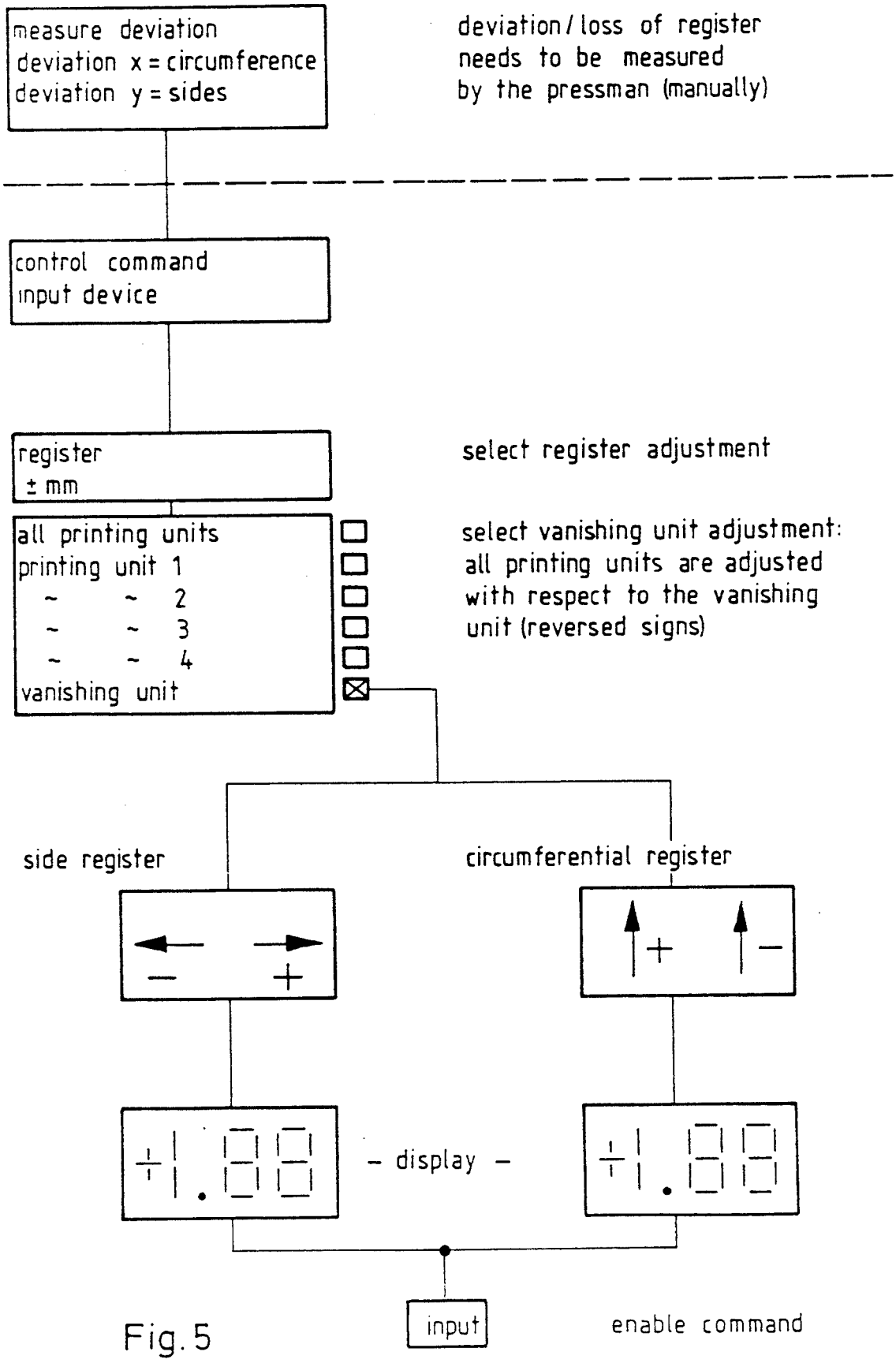
Figure 6:
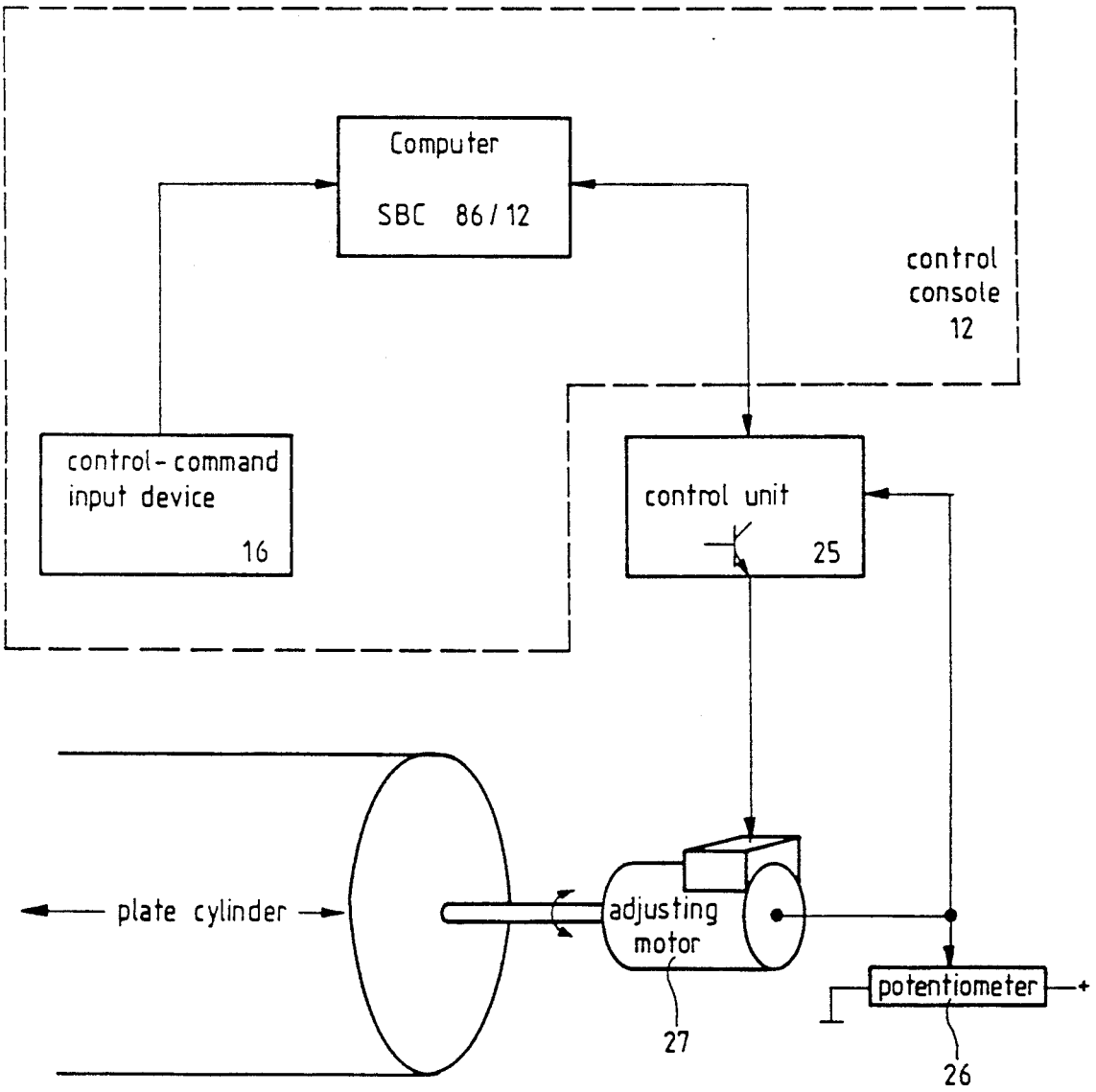

The construction and method of operation of the invention however, together with additional objects and advantages thereof will be best understood from the following descrip-tion of specific embodiments when read in connection with the accompanying drawings, in which:

FIG. 1 is a diagrammatic and partly schematic side elevational view of an offset printing machine for multicolor printing having a varnishing unit and embodying the device for adjusting the register in a printing machine having a plurality of printing units, in accordance with the invention;

FIG. 2 is a fragmentary plan view of a sheet to be printed which is provided with register cross markings; FIG. 3 is a reduced plan view of a sheet having a position which is adjustable by side and front lays in the printing machine; FIGS. 4*a*, 4*b* and 4*c* are fragmentary plan views of a printed sheet showing various color separations produced in the offset printing machine;

FIG. 5 is a flow diagram for a control unit forming part of the register-adjusting device according to the invention; and FIG. 6 is a schematic and diagrammatic view of the register-adjusting device according to the invention.

Referring now to the drawing and, first, particularly to FIG. 1 thereof, there is shown diagrammatically an offset printing machine 1 having four printing units 2, 3, 4 and 5. The offset printing machine 1 is in the form of a sheet-fed printing machine, sheets 8 forming the material 7 which is to be printed being fed thereto via a sheet feeder 6, the sheets 8 then running through the individual printing units 2 to 5 and being removed at the end of the machine and preferably piled up thereat as a sheet pile 9.

The printing units 2 to 4 are provided with circumferential and side register adjusting devices 10 for register adjustment. The respective actuator or adjustment drive for the circumferential register is identified by the reference character U, and the respective adjustment drive or actuator for the side register by the reference character S. The adjustment drives U and S are connected via lines 11 to a control console 12 of the offset printing machine 1. The control console 12 is further connected via lines 13 to adjustment drives or actuators VM and SM of front and side lays 14 and 14', respectively, which determine the position of the sheet 8. Whereas the printing units 2 to 4 produce various color separations in multicolor printing, the printing unit 5 represents a varnishing or lacquering unit 15. The varnishing unit 15 has no circumferential or side register adjusting devices, so that the register or subject position thereof is dependent upon the position of the blanket on the appertaining blanket cylinder. A simple register correction, as in the printing units 2 to 4, is unable to be performed in the varnishing unit 15, because a change in the position of the blanket is possible only by applying elaborate or expensive measures (loosening, positioning, clamping). Insofar as the instant application is involved, the printing unit 5 is assumed to be a nonadjustable printing unit.

In accordance with the invention, however, the effect of a register adjustment of the nonadjustable printing unit 5 by means of a control command-input device 16, which is accommodated in the control console 12 and cooperates with a control device 25, is achievable in that a relative change in position of the subject of the nonadjustable printing unit 5 results from logically consistent register adjustments of the adjustable printing units 2 to 4. In accordance with the desired, yet impossible, register adjustment of the printing unit 5 due to its lack of adjustability, the effect of an adjustment is produced in that the other, adjustable printing units 2 to 4 are adjusted in their respective subject positions by means of the actuators or adjustment drives U and/or S relative to the printed subject of the printing unit 5. This adjustment has the final effect that all of the printing units 2 to 5 assume those positions relative to one another which should, in fact, have been attained by the adjustment (not possible, however) of the register of the printing unit 5.

In order to facilitate the positioning of the individual printing plates of the various color separations, register markings 17 (FIG. 2) in the form of register crosses 18 are provided in the non-image region of the sheet 8, particularly in corner regions of the sheet 8. To the extent that the register crosses 18 associated with the printing units 2 to 4 are disposed above one another in mutual alignment, i.e., without overlap, the printing plates are in correct positions necessary for satisfactory printing results. No register crosses are associated with the printing unit 5 in the form of the varnishing unit 15; the necessary, correct alignment of the appertaining subject with respect to the positions of the subjects of the other printing units 2 to 4 must therefore be performed by the operator (printer) by means of visual examination, particularly based upon a comparison of the positions of the margins or borders of the subjects. If deviations are found, the effect of a register adjustment of the actually non-adjustable printing unit 5 can be achieved based upon the measures according to the invention.

The principle upon which the invention of the instant application is based is explained hereinafter with reference to FIG. 3 which illustrates a sheet 8 on which a color separation 19 is arranged. The color separation 19 has been produced by one of the printing units 2 to 4 (in the interest of simplicity, the discussion herein is initially confined to the color separation of only one printing unit). The subject 20 of the varnishing unit 15 is represented with single-line hatching in FIG. 3. The color separation 19 and the subject 20 exhibit a relative positional deviation so that they are not in mutual alignment and, in fact, overlap one another. The deviation X applies to the circumferential register of the adjustable printing unit (e.g. the printing unit 4), and the deviation Y to the appertaining side register. A register marking 17 associated with the color separation 19 and lying in a corner of the subject therefore has a position P1 which deviates from a position P2 which is assumed by the upper right-hand corner (as viewed in FIG. 3) of the subject 20 of the varnishing unit 15. Because a register adjustment of the varnishing unit 15 is not possible, a logically consistent register adjustment of the adjustable printing unit is performed in accordance with the invention so that the color separation 19 is brought into alignment (i.e., without overlap) with the subject 20. During the adjustment process, the position P1 travels towards the position P2 until both positions are in aligned superimposition. In the course of the register adjustment, the color separation 19 is thus shifted distances corresponding to the deviation X and the deviation Y. This shift or displacement results in a change in the distances between the color separation 19 and edges 21 and 22, respectively, of the stock material being printed on. In order to be able to re-establish the original relationships, the front lays 14 and the side lays 14' are adjustingly moved over the respective deviations X and Y by the respective adjustment drives or actuators VM and SM likewise in the same direction and by the same amount, so that the sheet 8 assumes a corresponding, new position.

The correction of the register settings of the printing machine 1 in accordance with a preferred procedure is explained hereinafter. In FIGS. 4*a*, 4*b* and 4*c*, there are shown a color separation 23 of the printing unit 2, a color separation 24 of the printing unit 3, as well as the color separation 19 of the printing unit 4. The subject 20 of the varnishing unit 15 is likewise shown in FIGS. 4*a* and 4*b*, in fact, in solid lines. In FIG. 4*a*, all of the color separations 19, 23 and 24, as well as the subject 20 have different positions. In the interest of clarity, the deviations shown have been exaggerated. It is assumed that the color separation 23 is located a distance a from the upper edge 21 of the stock material which is to be printed on, and is spaced a distance b from the side edge 22 of the stock material. It is further hypothesized that the distances a and b are of the respectively desired amount, so that the color separation 23 assumes the correct position on the sheet 8. The printing unit 2 associated with the color separation 23 therefore represents a lead printing unit, the corresponding color of this lead printing unit being designated the base color.

A specimen sheet is then taken from a proof and is visually evaluated by the printer with regard to the positional correction required between the subject 20 and the color separation 23. In accordance with FIG. 4*b*, a correction of the circumferential register by a distance c and, of the side register, a shift of a distance d are required; because the color impression 23 is already in its correct position with respect to the printing stock edges 21 and 22, it is necessary, in fact, to perform a corresponding register adjustment of the varnishing unit 15. This is not possible, however, because, as explained hereinbefore, the printing unit 5 is not provided with circumferential and side register adjusting devices. In this respect, in accordance with the invention, the effect of the register adjustment of the non-adjustable printing unit 5 by inputting the values c and d determined by the printer into the control-command input device 16 of the control console 12 results in a relative change in position being performed with logical consistency by the register of the adjustable printing unit 2.

In order to avoid any necessity for the printer to determine visually the positional deviations of the subject 20 with respect to the color separations 24 and 19 of the printing units 3 and 4, respectively, and to input those deviations to the control console, there is provided an automatic determination of position-deviation data e, f, g and h, resulting from the relative position of the color separations 24 and 19 with respect to the color separation 23 of the lead printing unit. These position-deviation data e, f, g and h are established by determining the positions of register crosses 18 (FIG. 2) associated with each of the color separations 19, 23 and 24. In this regard, a so-called register cross reader is installed which has an optical system by which it scans the register crosses 18 and, therefrom, indicates on a display the necessary adjustment data corresponding to the position-deviation data or, alternatively, in accordance with another feature of the invention, feeds the adjustment data to the control console 12 for automatic correction of the register settings. Because, in this regard, the relative positions of the color separations 19 and 24 with respect to the color separation 23 of the lead color are known to the control system of the printing machine 1 and, further, the positional deviation between the subject 20 and the color separation 23 has been inputted by the printer, a correspondingly logically consistent register adjustment of the printing units 2, 3 and 4 can be effected in such a manner that all of the printed images are mutually superimposed in alignment (without overlap) with the subject of the varnishing unit 15.

The printed image of the finished printed product would then, however, assume a faulty or incorrect position with respect to the edges 21 and 22 of the printing stock. To eliminate this incorrect positioning, as mentioned hereinbefore with respect to FIG. 3, the side and front lays 14' and 14, respectively, are adjusted in magnitude and direction in accordance with the dimensions c and d (FIG. 4*b*), so that the desired distances a and b are re-established.

FIG. 5 represents a flow chart for the control device 25. To start with, the deviation of the varnishing unit with respect to its nominal value is measured either by the printer or automatically. The resultant value is inputted into the control-command input device and the printing unit is selected wherein the register is to be adjusted. This selected printing unit is then reset both with respect to the side register as well as with respect to the circumferential register of the register setting of the varnishing unit until they mutually agree. The operation is performed with respect to all of the printing units. The display provides the amount of the adjustment of a printing unit in millimeters so that the printer can check whether the printing unit would be adjusted with respect to the side or the circumferential registers thereof by the same amount as that by which the varnishing unit deviates from its nominal value.

FIG. 6 diagrammatically and schematically illustrates the device of the invention. Shown therein is the control-command input device 16 which is connected to a conventional SBC 86/12 computer. This computer is, in turn, connected to and operates on the control device 25 which controls the operation of a servomotor 27. A potentiometer 26 provides information as to the extent of adjustment which has been performed.

I claim:

1. A sheet printing machine for printing images on sheets having a plurality of register-provided units, a circumferential and a side register in each of said register-provided printing units for performing respective circumferential and side registration in said register-provided printing units; a register-free printing unit having no circumferential and side register; a plurality of adjustable front and side lays disposed ahead of at least one of said printing units for aligning the edges of the images; and a control device operatively engaging said circumferential and side registers and said front and side lays for controlling positions of said registers and lays.

2. A sheet printing machine according to claim 1, wherein said register-free printing unit is a varnishing unit.

3. A sheet printing machine according to claim 1, including a command input device operatively engaging said control device for entering control commands into said control device.

4. A sheet printing machine according to claim 3, including at least one register marking on at least one of said sheets, a register marking reader for automatically reading the position of said register marking, and means for transmitting the position of said register marking to said control device for automatically positioning said front and side lay.

5. Method according to claim 1, which includes setting the registers and adjusting side and front lays uniformly at low speed for aligning stock material fed into the printing machine.

6. Method according to claim 5, wherein the speed of the setting and adjusting is dependent upon at least one of the length of positioning travel and machine speed.

7. Method according to claim 5, wherein the speed of the setting and adjusting increase with an increase in machine speed.

8. Method for automatically correcting registers of a sheet printing machine having a plurality of register-provided printing units, each register-provided unit provided with a circumferential and a side registers and a register-free printing unit having no circumferential and side register, the method comprising the steps of determining a register deviation between an image printed by at least one of said register-provided printing units and an image printed by said register-free printing unit, and adjusting the registers of said at least one of said register-provided printing units so as to cancel said register deviation.

9. Method according to claim 8 including in said sheet printing machine a register mark reader for reading said register deviation, a control device for controlling the position of said registers of said register-provided printing units, and an adjustable front and side lay on at least one of said register-provided printing units, the method further comprising the steps of:

(a) selecting one of said register-provided printing units as a lead printing unit;

(b) aligning by means of said register mark reader the images printed on the other register-provided printing units with the image printed on said lead printing unit;

(c) next determining the edge deviation between the edges of the image printed on the lead printing unit and the edges of the image printed on the register-free printing unit; and (d) adjusting the front and side lay so as to cancel said edge deviation.

10. Method according to claim 9, further comprising the step of selecting as lead printing unit the register-provided printing unit, the printed image of which exhibits the least edge deviation from the image printed by the register-free printing unit.

11. Method according to claim 9, including a control device having operator control inputs for adjusting said front and side lay, and manual edge-reading means enabling a printing machine operator to manually determine said edge deviation, the method further comprising the step of determining manually the edge deviation, and entering manually the edge deviation into said control device so as to cancel said edge deviation.

* * * * *